United States Patent [19]

Day

[11] 4,419,149

[45] Dec. 6, 1983

[54] METHOD FOR QUENCHING HEATED WORKPIECES

[75] Inventor: Paul L. Day, Parma, Ohio

[73] Assignee: Park-Ohio Industries, Inc., Shaker Heights, Ohio

[21] Appl. No.: 234,201

[22] Filed: Aug. 19, 1981

Related U.S. Application Data

[62] Division of Ser. No. 113,691, Jan. 21, 1980, Pat. No. 4,336,924.

[51] Int. Cl.[3] ..... C21D 9/00

[52] U.S. Cl. ..... 148/131; 148/150; 148/153

[58] Field of Search ..... 148/143, 153, 150, 131

[56] References Cited

U.S. PATENT DOCUMENTS 3,944,446 3/1976 Bober ..... 148/153

*Primary Examiner*—R. Dean

*Attorney, Agent, or Firm*—Body, Vickers & Daniels

[57] ABSTRACT

A method and apparatus for quenching heated elongated workpieces by rotatably mounting the heated workpiece in a quench tank and subsequently rapidly flooding the tank with a quenching liquid. The heated workpiece is mounted within the quench tank by engaging opposite axial ends of the elongated workpiece. Transverse deflection of the workpiece is prevented by paired restraints located adjacent the top and bottom of the workpiece near the opposite ends. As the quenching liquid is flooded into the quench tank from a storage tank, the heated elongated workpiece is rotated about its central axis at a fixed speed.

3 Claims, 9 Drawing Figures

METHOD FOR QUENCHING HEATED WORKPIECES

This is a division of application Ser. No. 113,691 filed Jan. 21, 1980 U.S. Pat. No. 4,336,924.

The present invention relates to the art of quenching inductively heated enlongated workpieces and includes a method and apparatus for quenching inductively heated workpieces while preventing transverse deflection along the length thereof. The present invention is particularly adapted for processing an elongated inductively heated workpiece and it will be described with respect thereto; however, the invention has broader applications and may be used to process various workpieces heated by different processes.

BACKGROUND OF THE INVENTION

In processing elongated workpieces, it is often necessary to heat treat the workpieces by heating and then quenching. When the heating is done by induction heating techniques, the quenching operation can be performed by rotating the workpiece in a body of quenching liquid. The present invention relates to this type of processing.

In the past, it was common practice to quench a heated workpiece by mounting the workpiece between axially spaced centers so that the workpiece could be rotated about its central axis. In order to limit transverse deflection, it has been the practice to provide opposed restraining devices, such as rollers. These rollers limited deflection of the workpiece while rotary motion of the workpiece made this process uniform. Rotation of the heated, elongated workpiece provided an additional benefit to the quenching operation by resisting the development of steam pockets at the surface of the workpiece caused by the heated workpiece contacting the quenching liquid.

The rotation and restraint devices were built into a support mechanism for the elongated workpiece. In the past this complex mechanism was movable between a loading position above a quench tank and a lowered position in the quench tank. The workpiece and support mechanism were removed from the quenching liquid after quenching and the workpiece then released from the support mechanism. Providing translation of the support mechanism for the elongated workpiece was expensive and complicated. In addition, providing a mechanism for rotating the workpiece about its central axis and a mechanism for preventing transverse deflection on the movable support mechanism was difficult and required substantial space and bulky support structures.

The disadvantages of the prior art have been overcome by the present invention which provides a quenching device and method using a fixed support mechanism for an elongated workpiece that includes a mechanism to restrain transverse deflection and to rotate the workpiece about its central axis.

THE INVENTION

In accordance with the present invention, there is provided an improvement in an apparatus and a method for quenching a heated elongated workpiece while minimizing transverse deflection of the workpiece. The apparatus supports the heated elongated workpiece within a quench tank while providing opposed restraint against transverse deflection and simultaneously rotating the workpiece. With the heated workpiece mounted and rotating in a selected position within the tank, the quench tank is rapidly flooded with quenching liquid. In this manner, the supporting structure can be relatively simplified without distracting from the quenching operation.

In accordance with a primary object of the present invention there is provided an improved apparatus for quenching a heated elongated workpiece, which apparatus supports the elongated workpiece at a selected position within a quench tank, which prevents transverse deflection of the workpiece by relatively displacable opposed restraining members, and which rotates the elongated workpiece about its central axis while rapidly flooding the quench tank with a quenching liquid.

Still a further object of the present invention is the provision of an improved method for quenching a heated elongated workpiece in which the workpiece is positioned within a support in a quench tank, restrained from transverse deflection at opposed surfaces, and rotated about its central axis; in which a quenching liquid is rapidly flooded into the quench tank while transverse deflection of the workpiece is restrained and the workpiece is rotated about its central axis; and, in which the quenching liquid is transferred from the quench tank subsequent to a quenching operation.

BRIEF DESCRIPTION OF THE DRAWINGS

The invention may take physical form in a variety of parts and arrangements of parts, preferred embodiments of which will be described in the following specification and are illustrated in the accompanying drawings which form a part hereof and wherein.

DETAILED DESCRIPTION OF THE PREFERRED EMBODIMENTS

Figure 1:
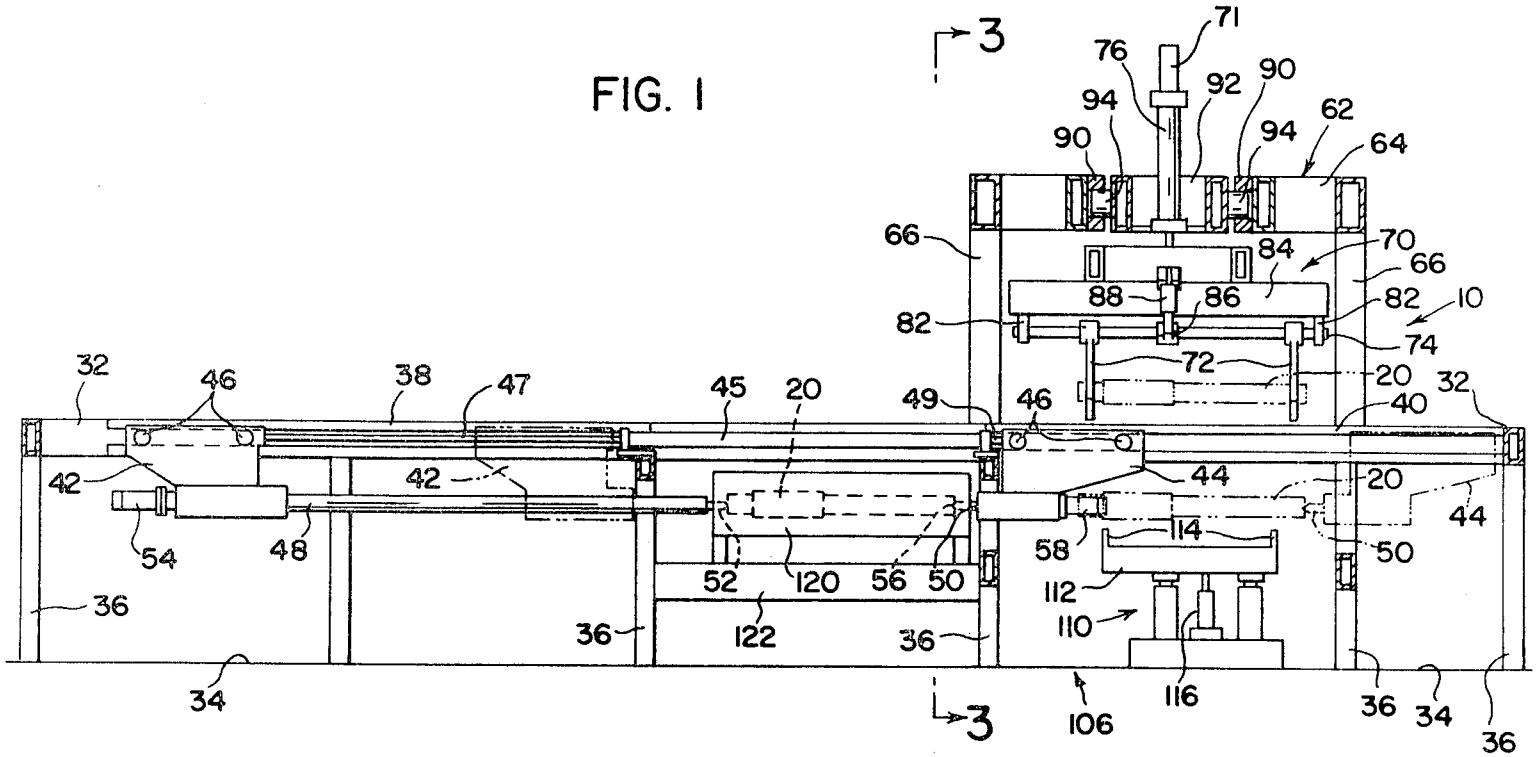
FIG. 1 is a front elevation view of a heat treating device for heating and quenching elongated workpieces.
Figure 2:
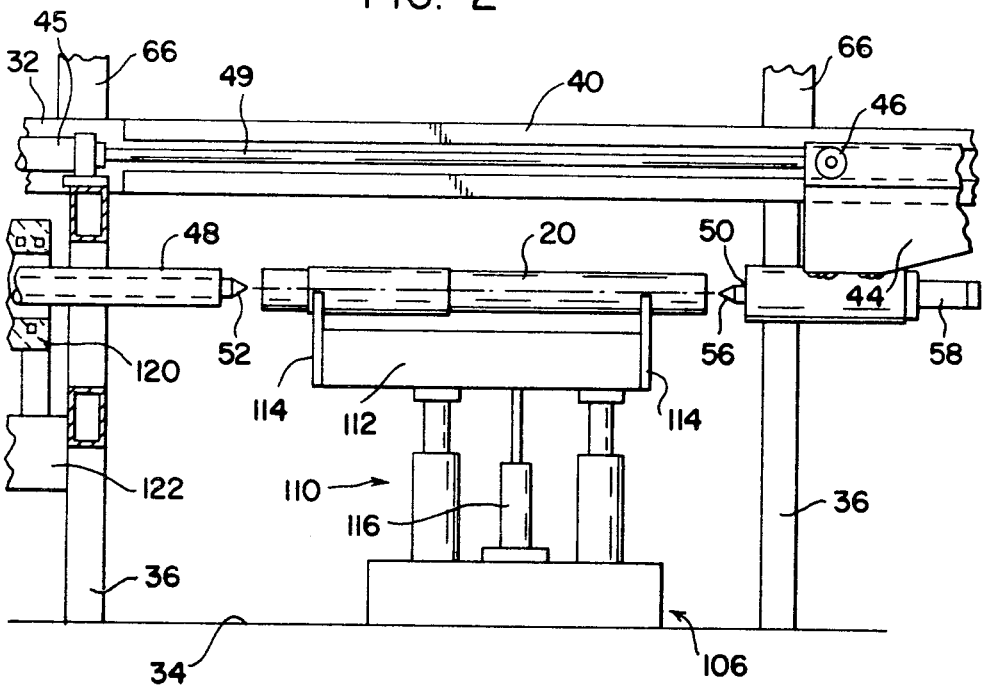
FIG. 2 is an enlarged partial front elevational view illustrating a heating station of the heat treating device shown in FIG. 1.

Referring now to the drawings wherein the showings are for the purpose of illustrating the preferred embodiments of the invention only, and not for the purpose of limiting the same, FIG. 1 illustrates a heat treating device 10 which accommodates elongated workpieces 20 for successive treatment including heating and quenching by deluging the workpiece in a body of liquid. Heat treating device 10 is supported by a generally longitudinal frame 32 vertically above and parallel to a floor or ground level 34. A plurality of support struts 36 extend perpendicularly between the longitudinal frame and the floor. During heating, workpiece 20 is supported from longitudinal frame 32 by first and second pairs of opposed rail portions 38 and 40, respectively, within which carriages 42 and 44 are slidably supported. Carriage 42 is permanently but slidably secured to first rail portions 38, while carriage 44 is likewise permanently and slidably secured to second rail portions 40. Slidably mounting carriages 42 and 44 may be accomplished by any suitable means, but preferably comprises rotatably mounted rollers 46 permanently secured at each corner of carriages 42 and 44 and rotatably engaging rails 38 and 40. A movement means such as a cylinder 45 having left and right extendable rods 47 and 49 respectively, moves the carriages in spaced unison along the paired rail portions from a left extreme of the rail portions (shown in solid lines) to a right extreme (shown in phantom lines). This movement of the carriages in unison provides a constant space between the carriages to support the workpiece before, during and after movement.

Support of the workpiece during heating is provided by adjustable guide sleeve 48 extending from carriage 42 in the direction of carriage 44, and adjustable guide sleeve 50 extending from carriage 44 axially toward and parallel with guide sleeve 48. A right extreme of guide sleeve 48, as viewed in FIG. 1, has a centering point 52 extending outwardly therefrom. Adjustability of centering point 52 is provided by a drive mechanism 54 secured at the left extreme of guide sleeve 48. As in the case of guide sleeve 48, guide sleeve 50 includes a centering point 56 extending outwardly from the left extreme of the sleeve. A drive mechanism 58 secured at the right extreme of guide sleeve 50 provides for adjustability of the centering point. The workpiece is supported between centering points 52 and 56.

A superstructure 62 providing support for movement of the workpiece between heating and quenching is secured above longitudinal frame 32. Superstructure 62 includes a horizontal frame 64 suspended parallel to longitudinal frame 32 by vertical supports 66. A lift mechanism 70 is supported by horizontal frame 64 and is vertically movable relative to the horizontal frame and longitudinal frame 32 along parallel guide sleeves 71. Lift mechanism 70 includes spaced lifting hooks 72 selectably positionable to support workpiece 20. Lifting hooks 72 are fixedly secured to a rod 74 supported by the lift mechanism, and may be adjustably positioned therealong. A hydraulic cylinder 76 provides vertical movement of lift mechanism 70. With hydraulic cylinder 76 fully retracted, as shown in FIG. 1, the workpiece is supported above longitudinal frame 32. Operation of hydraulic cylinder 76 to a fully extended position results in the lowering of the workpiece to a level below longitudinal frame members 32, as for example, when moving the workpiece between centering points 52 and 56 for heating of the workpiece as shown in phantom lines in FIG. 1, at the right extreme limit of travel of carriages 42 and 44.

Figure 3:
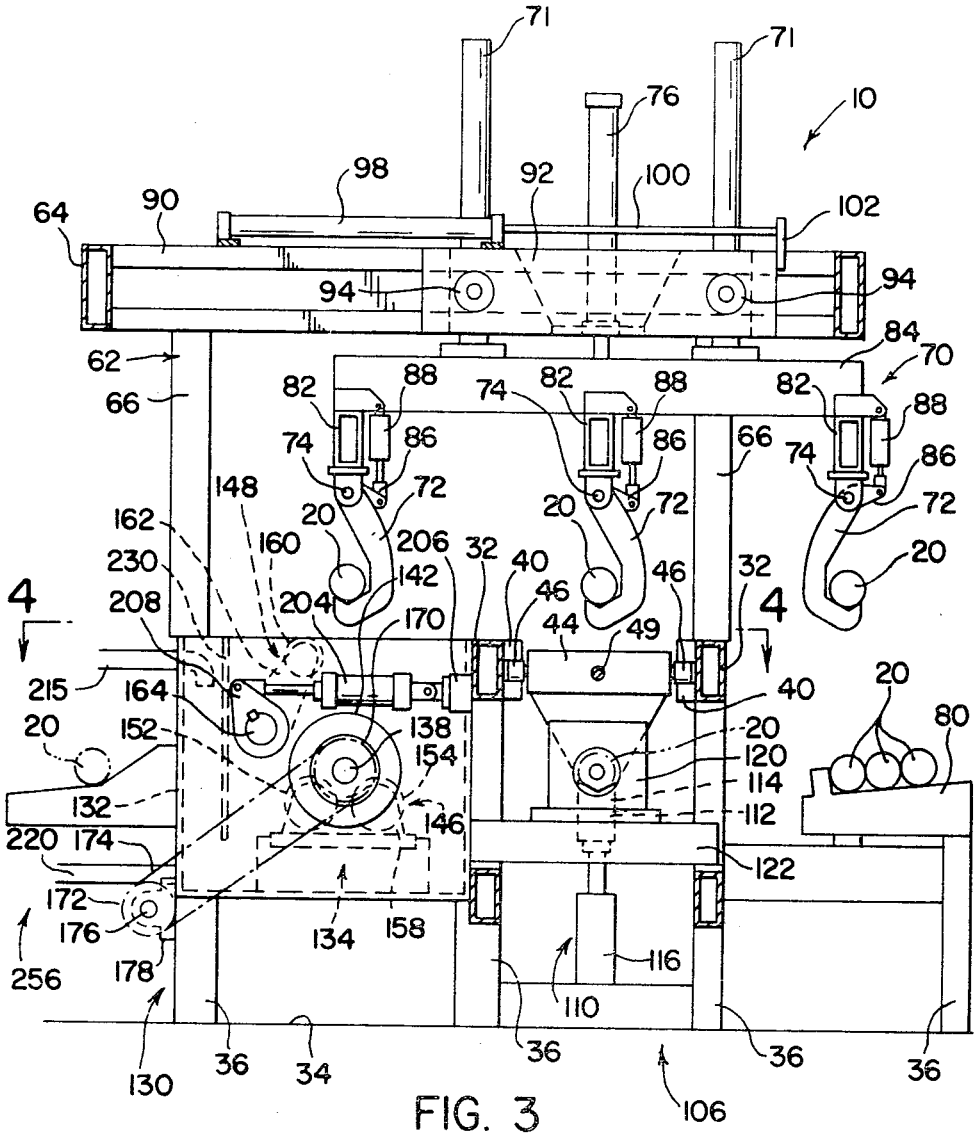
FIG. 3 is a cross-section view of the heat treating device taken along line 3—3 of FIG. 1 and illustrating heating and quenching stations.

FIG. 3 is helpful to understand the operation of lift mechanism 70. Untreated workpiece 20 is lifted from a supply table 80 by lifting hooks 72 of the lift mechanism. Rod 74, supporting the hooks, is rotatably held by supports 82 which are permanently secured to a lift frame 84. Positioned between lift frame 84 and an arm 86, fixedly secured to rod 74, is a cylinder 88 which may be either hydraulically or electrically actuable between extended and retracted positions. Retraction of cylinder 88 enables workpiece 20 to be carried by the lifting hooks. Extension of cylinder 88 causes the hooks to pivot about rod 74 for loading or unloading of the workpiece. Lift frame 84 preferably supports three sets of lifting hooks 72 on three parallel rods 74.

Hydraulic cylinder 76, enables lift mechanism 70 and thus frame 84 to move from the upper position shown in FIG. 3 to a lower, release or pickup, position (not shown). Lift mechanism 70 is also movable along a horizontal plane. A pair of opposed rails 90 provided at either side of the superstructure slidably engage a carriage 92 by any suitable means, such as rollers 94 secured to the carriage and rotatable within the rails. Horizontal movement of the lift mechanism is accomplished by a cylinder 98 secured between horizontal frame 64 of the superstructure and carriage 92. While the body of the cylinder 98 is secured to the horizontal frame, a piston 100 of the cylinder is secured to the carriage at a bracket 102.

Once workpiece 20 has been lifted by lifting hooks 72 of the lift mechanism, cylinder 98 is retracted to transfer the workpiece and lift mechanism to the left, as viewed in FIG. 3, to a heating station 106. Hydraulic cylinder 76 is then extended to lower lift mechanism 70. With the workpiece positioned at a lower vertical extreme, a support table 110 lifts a support structure 112, having spaced upwardly projecting supports 114, into engagement with workpiece 20. Support table 110 is lifted by operation of a hydraulic cylinder 116 positioned between support structure 112 and the floor level 34. Once the support table engages the workpiece, lifts it and aligns it axially with centering points 52 and 56, cylinder 88 is operated to cause lifting hooks 72 to release the workpiece. Hydraulic cylinder 76 is then retracted to raise lift mechanism 70 and cylinder 98 returns the lift mechanism to its rightmost position as shown in FIG. 3. Drive mechanism 54 and 58 of the centering points then operate to engage the axial ends of workpiece 20 providing independent support of the workpiece. Support structure 112 is lowered by retraction of hydraulic cylinder 116 after the centering points engage the workpiece.

The first stage of the heat treating process of device 10 occurs when carriages 42 and 44 drive workpiece 20 to the left, as viewed in FIG. 1, into an induction heating furnace 120. Furnace 120 is supported on longitudinal frame 32 in axial alignment with centering points 52 and 56 by a subframe 122 connected to the upright supports 36. After the temperature of the workpiece within induction heating furnace 120 reaches the desired level for the particular heat treating operation being undertaken, carriages 42 and 44 are moved to position workpiece 20 above the support table, at the right of FIG. 1. Support table 110 raises support structure 112 into contact with workpiece 20 after which drive mechanisms 54 and 58 release the workpiece onto support structure 112.

After heating station 106 functions, according to the above description, lift mechanism 70 is again lowered by extension of cylinder 76 and cylinder 88 is retracted to allow lifting hooks 72 to move under workpiece 20. Retraction of cylinder 116 lowers support structure 112 causing the workpiece to be supported by the hooks. Extension of cylinder 88 and retraction of cylinder 76 results in the lift mechanism carrying the workpiece to the upper limit, as shown in FIG. 3. Horizontal cylinder 98 is then operated causing lift mechanism 70 and the heated workpiece to again move left to a position above a quenching station 130.

FIGS. 3 through 6 are useful in explaining the construction and operation of quenching station 130. Hydraulic cylinder 76 is again operated to cause lift mechanism 70 and the workpiece to be lowered into a quench tank 132 having liquid containing bottom and sides. The workpiece is lowered onto a mounting mechanism 134 which supports the workpiece within quench tank 132 while rotating the workpiece about a central axis a and preventing transverse deflection. Mounting mechanism 134 supports elongated workpiece 20 by opposed mounting pins 138 and 140 which engage axially opposite ends of the elongated workpiece at central axis a. Mounting pins 138 and 140 are permanently, rotatably supported within quench tank 132 by liquid sealing bearings 142.

Mounting mechanism 134 also includes generally diametrically opposed roller devices 146 and 148 intended to restrain transverse deflection of the workpiece. Roller device 146 includes two spaced pairs of adjacent rollers 152 and 154 each pair rotatably secured on a parallel axis 156 supported within a frame member 158. Roller device 148 includes one spaced pair of rollers 160 rotatably mounted in axial alignment from paired brackets 162, in turn secured to a pivot shaft 164 pivotally supported on a frame member 166. While any number of roller devices 146 and 148 may be provided at spaced intervals along the length of workpiece 20 between axially opposite ends thereof, preferably two sets of each are provided. Roller devices 146 and 148 are arranged to either contact the outer surface of workpiece 20 or be positioned radially spaced from the outer surface of the workpiece. Roller device 148 is displacable relative to roller device 146 for the purpose of allowing the workpiece to be inserted and retrieved from between the roller devices. When roller device 148 is in a first position, indicated in phantom lines in FIG. 5, insertion of workpiece 20 between the roller devices is possible; and, when roller device 148 is in a second position, indicated in solid lines in FIG. 5, the workpiece is restrained from transverse deflection.

Figure 4:
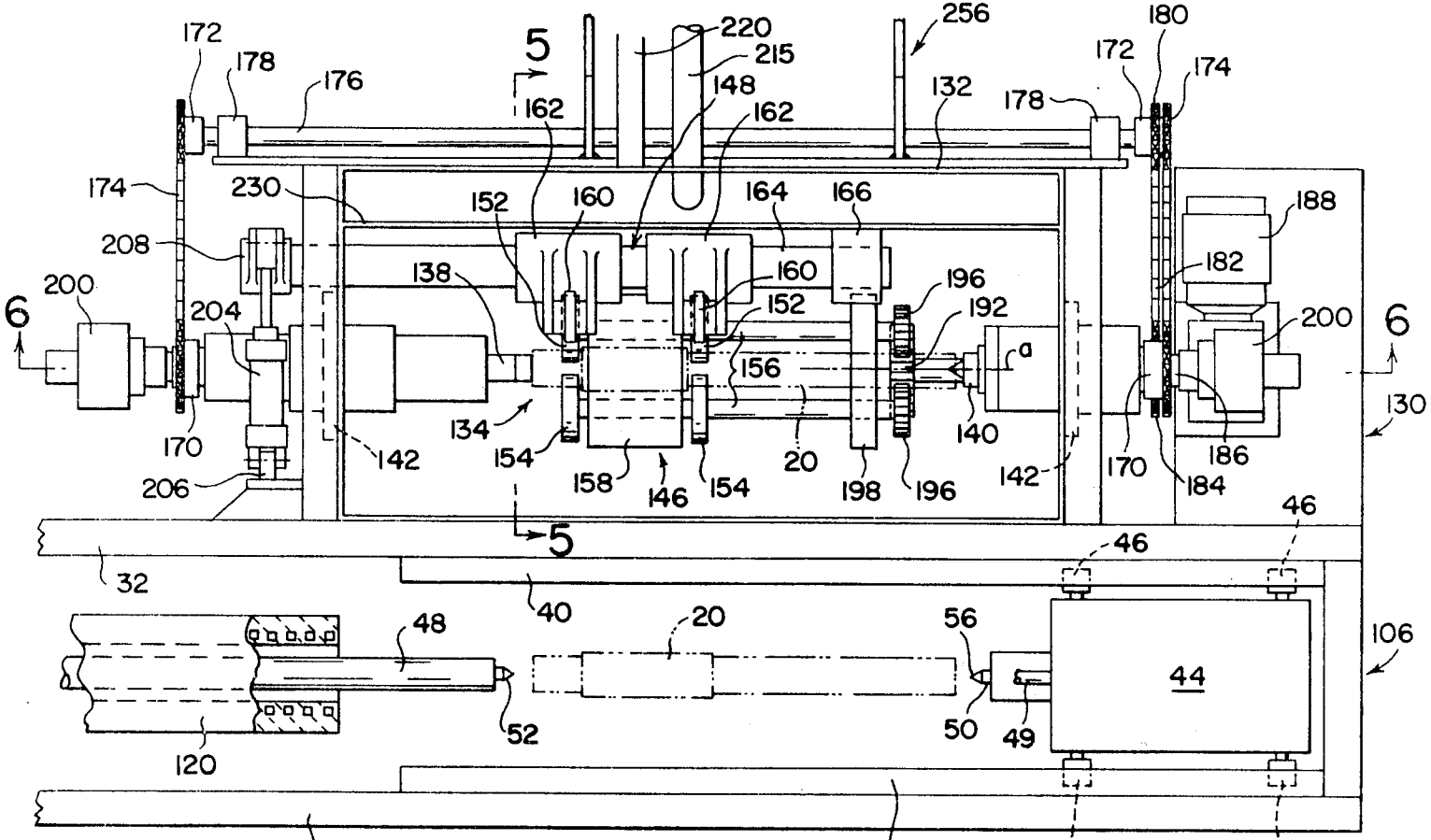
FIG. 4 is a cross-section view of the heat treating device taken along line 4—4 of FIG. 3 and further illustrating the heating and quenching stations.
Figure 6:
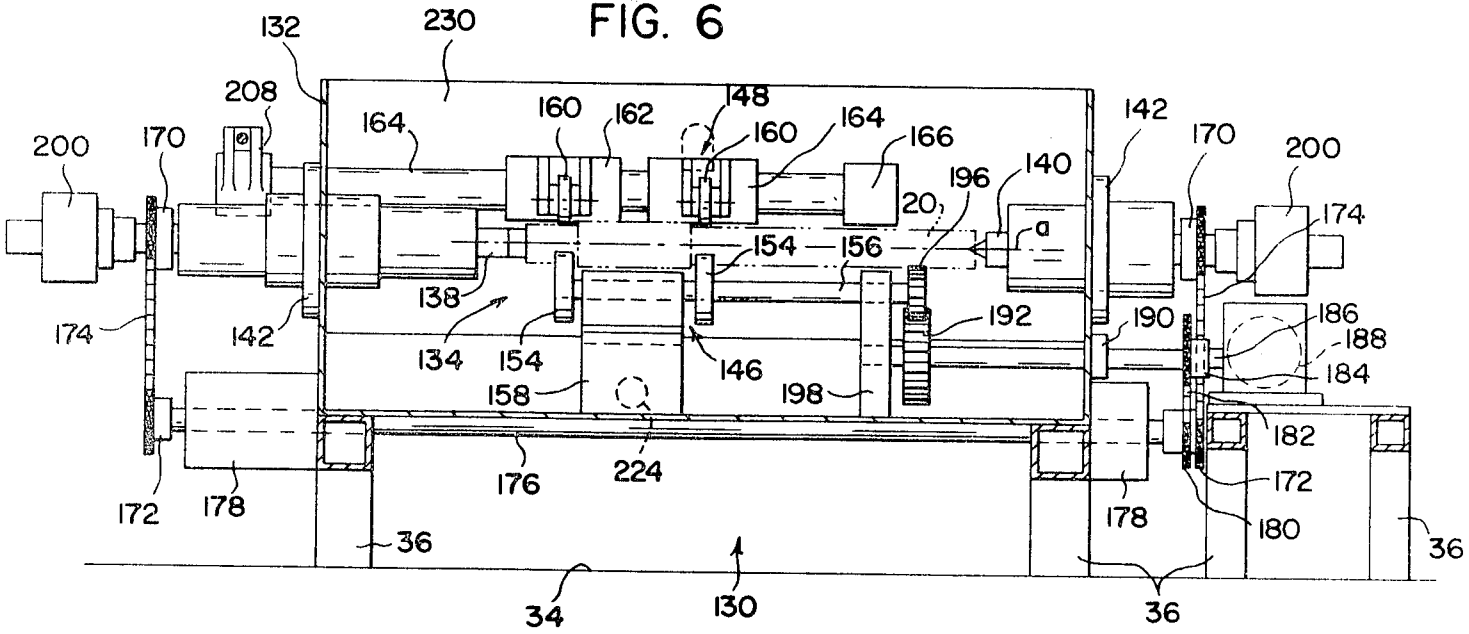
FIG. 6 is a cross-section view of the quenching station of the heat treating device shown in FIG. 1 taken along line 6—6 of FIG. 4.

In addition to workpiece 20 being supported by mounting pins 138 and 140 and restrained from deflection by roller devices 146 and 148, the workpiece is desired to be rotated about its central axis a. For this purpose mounting mechanism 134 includes a drive sprocket 170 permanently affixed to each mounting pin 138 and 140 (FIG. 4). Each drive sprocket 170 is drivingly connected to a driven sprocket 172 by a driven chain 174. Driven sprockets 172 are both fixed to a common drive shaft 176 which has a journal 178 on longitudinal frame 32. One of the driven sprockets has an additional sprocket 180 secured thereto and a chain 182 is trained around sprocket 180 as well as a sprocket 184 secured to an output shaft 186 of a motor 188. When the motor is energized, driven sprockets 172 drive sprockets 170 through drive chain 174 causing the workpiece to rotate about the central axis.

Rollers 152 and 154 are rotatably driven, to aid in rotation of the workpiece and resist scarring of the workpiece due to contact with the rollers, during rotation by a driven gear arrangement. Output shaft 186 of the motor extends through sprocket 184 and into quench tank 132 through a sealing journal 190. A gear 192 is secured to shaft 186 near the left end thereof. One of each pair of rollers 152 and 154 is fixedly secured to shaft 156 rotatably mounted in frame member 158 and a gear 196 is secured near the right end of each shaft 156. The free ends of shafts 156 and 186 are journalled at 198 and arranged to require gears 196 to drivingly mesh with gear 192. Mounting mechanism 134, shown in FIG. 5, represents a conventional arrangement for supporting an elongated workpiece for quenching, and as such, does not form part of the present invention.

Figure 7:
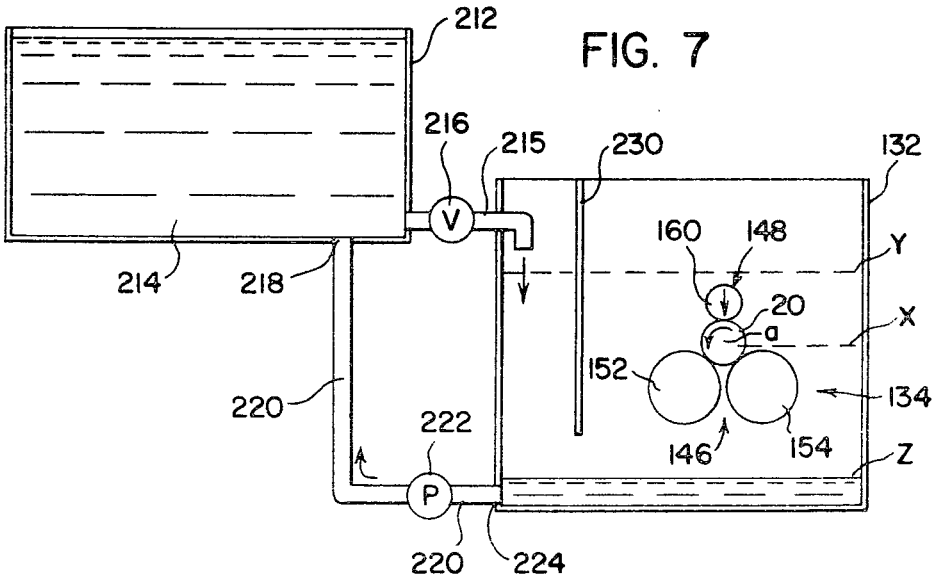
FIG. 7 is a schematic illustration of one embodiment of the present invention.

With the workpiece supported directly over quenching station 130, on lifting hooks 72 of the lift mechanism, hydraulic cylinder 76 is again actuated causing the lift mechanism and the workpiece to be lowered into the quenching station. Workpiece 20 is moved into engagement with rollers 152 and 154 and thus axially aligned with mounting pins 138 and 140 at a selected position "X" (FIG. 7). With the workpiece so positioned, drive mechanisms 200 located at the ends of mounting pins 138 and 140 drive the mounting pins toward one another into engagement with the workpiece. The lowering of the workpiece into quenching station 130 occurs with rollers 160 pivoted upward about shaft 164 as shown in the phantom lines in FIGS. 3 and 5. Since the workpiece engages and is supported by rollers 152 and 154, cylinder 88 may be retracted causing lifting hooks 72 to clear the workpiece while the lift mechanism is raised by the retraction of cylinder 76. Lift mechanism 70 is then moved to the right as shown in FIG. 3 by actuation of cylinder 98 in preparation for lifting of another workpiece.

Figure 5:
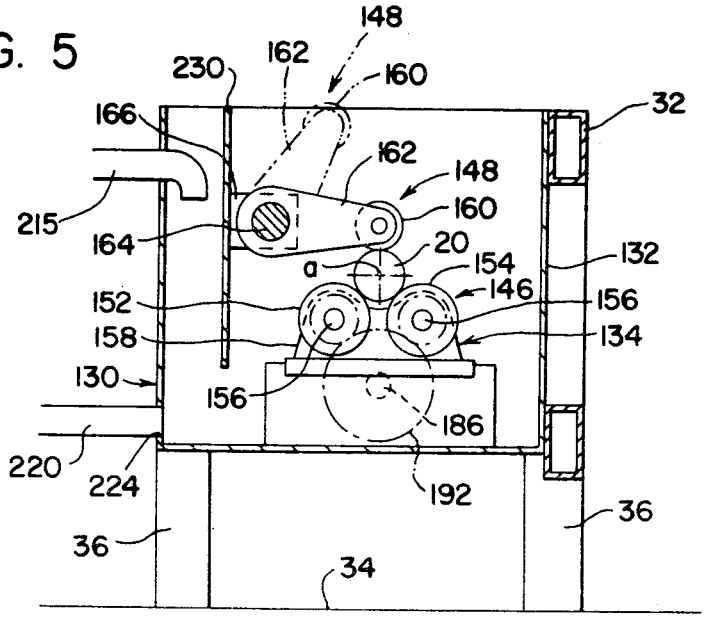
FIG. 5 is a cross-section view of the quenching station of the heat treating device shown in FIG. 1 taken along line 5—5 of FIG. 4.

Once mounting pins 138 and 140 support the workpiece, brackets 162 are pivoted downward about shaft 164 causing rollers 160 to move immediately adjacent to the workpiece, as shown in solid lines in FIG. 5. Movement of brackets 162 is caused by retraction of a cylinder 204 supported between a bracket 206 secured to quench tank 132 and an arm 208 secured to shaft 164. Extension of cylinder 204 results in movement of brackets 162 to the position shown in phantom lines in FIGS. 3 and 5. Quenching of the workpiece proceeds with the workpiece supported by mounting pins 138 and 140 and rollers 160, 152 and 154 either in contact with, or immediately adjacent to, the workpiece.

In accordance with one preferred embodiment of the present invention, the workpiece is supported at selected position "X" within quench tank 132 by mounting mechanism 134 (shown schematically in FIG. 7) while the quench tank is flooded with a liquid. Mounting mechanism 134, of course, provides for rotational motion of the workpiece about its central axis while supporting the workpiece at opposite axial ends thereof and restraining it from transverse deflection by roller devices 146 and 148. A storage tank 212, independent of quench tank 132, and having liquid containing bottom and sides is arranged vertically above and immediately adjacent to the quench tank. A quenching liquid 214 is contained within storage task 212. The storage tank has a pipe 215 provided with a valve 216 in one of the sides adjacent the bottom thereof immediately over quench tank 132. Storage tank 212 has an inlet opening 218 which is connected, by means of a pipe 220 having a pump 222 integral therein, to an outlet 224 of quench tank 132.

With the workpiece rotatably supported within the quench tank, valve 216 is opened allowing quenching liquid 214 to rapidly flood quench tank 132 and immerse the workpiece. Rapid flooding of the quench tank is accomplished by raising the level of the quenching liquid within quench tank 132 to an upper level "Y" (FIG. 7) above selected position "X" of the workpiece within a minimum amount of time. A baffle 230 provided within quench tank 132, prevents the quenching liquid from splashing onto the workpiece as the quenching liquid rapidly exits from valve 216. Selected position "X" of workpiece 20 results in upper level "Y" quenching liquid 214 being vertically above the highest point of the workpiece and mounting mechanism 134. When workpiece 20 has been sufficiently quenched, quenching liquid 214 is removed from quench tank 132 to a lower level "Z" (FIG. 7) below the workpiece by operation of pump 222. The quenching liquid is drawn out of the quench tank as shown by the arrow, through outlet 224 and pipe 220, through the pump and back into storage tank 212 through inlet 218. While the dimensions of quench tank 132 and size of valve 216 may vary, rapid flooding of the quench tank is accomplished by minimizing the time required to change the level of the quenching liquid within the quench tank from lower level "Z" to upper level "Y".

Figure 8:
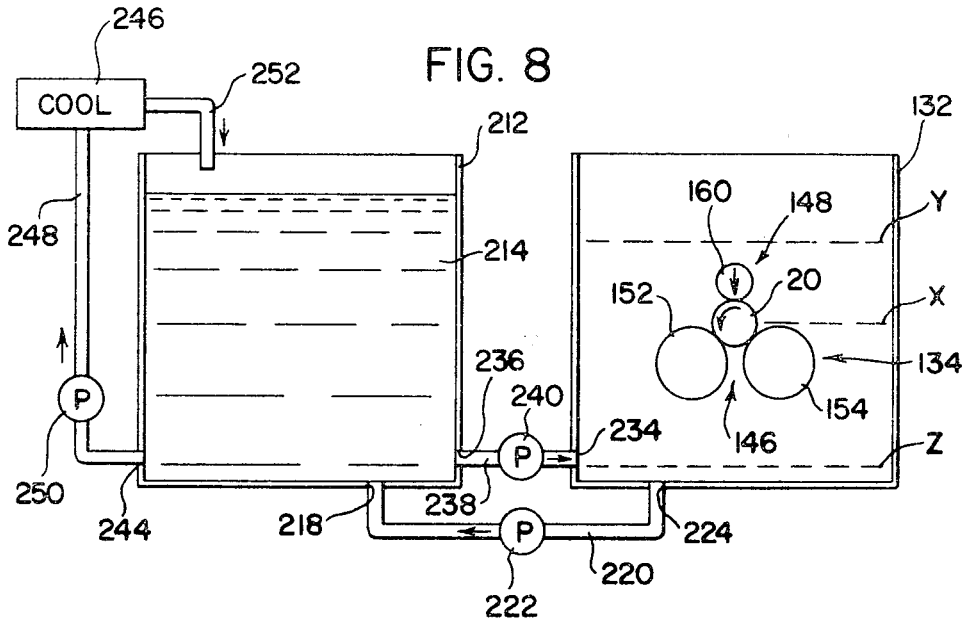
FIG. 8 is a schematic illustration of another embodiment of the present invention; and, FIG. 9 is a partially schematic illustration of one embodiment of fluid flow in the quenching station of the heat treating device.

A second embodiment, in accordance with the present invention, is shown in FIG. 8 wherein workpiece 20 is supported at selected position "X" by mounting mechanism 134, again illustrated schematically, while the quench tank is flooded with the quenching liquid. Storage tank 212 containing the quenching liquid is positioned horizontally spaced from, but on the same vertical level as, quench tank 132. An inlet 234 of the quench tank is connected to an outlet 236 of the storage tank by a pipe 238 having a pump 240 connected therein. Pipe 238 and pump 240 are intended to move quenching liquid 214 from the storage tank to the quench tank as shown by the arrow. Inlet 218 of storage tank 212 and outlet 224 of quench tank 132 are connected by pipe 220 having pump 222 integral therein. With workpiece 20 rotatably supported within the quench tank, pump 240 is operated to rapidly flood quench tank 132 with quenching liquid 214. Again, the quench tank is filled to upper level "Y" (FIG. 8). When workpiece 20 has been sufficiently quenched, the quenching liquid is removed from quench tank 132 to lower level "Z" (FIG. 8) and returned to storage tank 212 by operation of pump 222 in the direction of the arrow. Rapid flooding occurs as a result of minimizing the time required to raise the quenching liquid from lower leval Z to upper level Y.

Since quenching liquid 214 absorbs heat from workpiece 20 each time a workpiece is quenched, it may be, and preferably is, required that the quenching liquid be cooled after being used for quenching. Cooling of the liquid may be accomplished as shown in FIG. 8 wherein storage tank 212 has a cooling outlet 244 from which quenching liquid 214 flows to a cooling unit 246. The storage tank and cooling unit are connected by a pipe 248 having a pump 250 therein, in the direction shown by the arrow. The quenching liquid is extracted from the storage tank, cycled through cooling unit 246, and returned to the storage tank at a cooling outlet 252.

Preferably, pumps 222, 240 and 250 are electrically operated one-way pumps. The system shown in FIG. 8 could be arranged to substitute a single flow-through pump for pumps 222 and 240 wherein only one opening into each of quench tank 132 and storage tank 212 would be required. Where a single flow-through pump is used between the quench tank and storage tank, a valve for selectively blocking fluid flow against the pumping direction would be required.

After the workpiece has been sufficiently quenched and quenching liquid 214 removed from quench tank 132, workpiece 20 is removed from mounting mechanism 134. Motor 188 causing the workpiece to rotate about its center is deenergized. Cylinder 204 is extended to cause brackets 162 to pivot about shaft 164 thus removing rollers 160 from the workpiece. Lift mechanism 70 is then operated by retracting cylinder 88 causing lifting hooks 72 to pivot and extending cylinder 76 to cause lift mechanism 70 to lower the hooks into quench tank 132. When cylinder 76 has been fully extended such that lifting hooks 72 extend below the workpiece, cylinder 88 is extended causing the hooks to extend under the workpiece. Drive mechanisms 200 are operated causing mounting pins 138 and 140 to release the workpiece. Retraction of cylinder 76 results in lift mechanism 70 raising the workpiece from quench tank 132.

With the quenched workpiece supported by lifting hooks 72, lifting mechanism is moved to the left as shown in FIG. 3, by retraction of cylinder 98. The quenched workpiece is now located directly over an exit station 256, which may either comprise a stacking table or conveyor mechanism, where it is released by operation of lift mechanism 70 as noted above.

Figure 9:
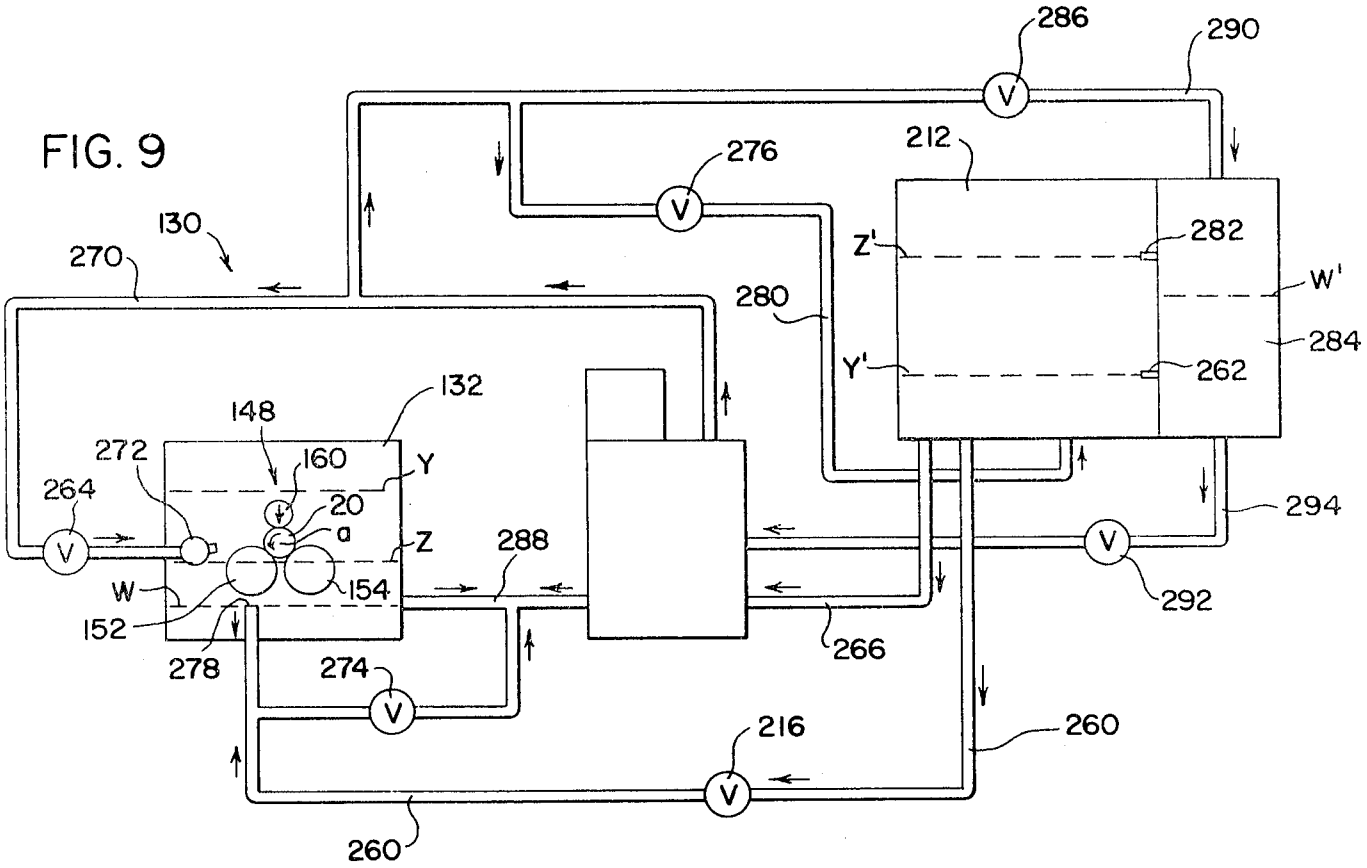

An embodiment of a complete fluid flow system for quenching station 130 is shown in FIG. 9, wherein quench tank 132 has upper level Y and lower level Z shown diagramatically. As noted above, when the workpiece is to be inserted or removed from the mounting mechanism permanently positioned within quench tank 132, the quenching liquid is at lower level Z in the quench tank. With the workpiece mounted, rotating and transversely supported within quench tank 132, the level of the quenching liquid within quench tank 132 is raised to upper level Y by movement of the quenching liquid from storage tank 212 to the quench tank. Storage tank 212 is initially filled with quenching liquid to a level indicated at Z'. Quick fill valve 216 is opened to cause the quenching liquid to exit from storage tank 212 through pipe 260 into quench tank 132. The movement of the quenching liquid from the storage tank to the quench tank continues until a sensor 262 indicates that the quenching liquid has reached a level indicated at Y', corresponding with upper level Y in the quench tank, at which time quick fill valve 216 is closed. Once the quenching liquid has reached upper level Y in the quench tank, an aggitation valve 264 automatically opens allowing the quenching liquid to move from storage tank 212 through a pipe 266 and into a pump 268, which in turn forces the liquid through a pipe 270 allowing the quenching liquid to flow into an aggitation channel 272. Aggitation channel 272 is located within quench tank 132 and has a plurality of apertures to provide pulsating jets or streams of quenching liquid within the quench tank to aggitate the quenching liquid and assisting in quenching of the workpiece.

After a preselected period of time sufficient to quench the workpiece, aggitation valve 264 closes, a quick drain valve 274 opens and quick fill tank valve 276 opens. Quenching liquid from quench tank 132 exits through pipe 278 and quick drain valve 274, and is forced by pump 268 through quick fill tank valve 276 and a pipe 280 back to storage tank 212. The flow of quenching liquid from quench tank 132 to storage tank 212 continues until a liquid sensing device 282 indicates the liquid within storage tank 212 has reached a level indicated as Z', corresponding to lower level Z in the quench tank. Once the lower level has been reached within the quench tank, quick drain valve 274 and quick fill tank valve 276 close.

As noted above, with the quenching liquid at lower level Z within quench tank 132, the workpiece may be removed or reinserted from the mounting mechanism within the quench tank. Lower level Z of the quenching liquid presents an unnecessary burden when service is required of the mounting mechanism locating within the quench tank. When such service is required, the quenching liquid within quench tank 132 is lowered from lower level Z to a servicing level W by pumping the additional quenching liquid from the quench tank to an auxiliary tank 284. This additional lowering of the quenching liquid is accomplished by opening an auxiliary tank fill valve 286 and operating pump 268 such that the quenching liquid is drawn through a pipe 288 into pump 268 and through valve 286 and a pipe 290 into the auxiliary tank. After the required servicing operations have been performed, the quenching liquid within quench tank 132 is again raised to lower level Z by opening an auxiliary tank empty valve 292 causing the quenching liquid to flow through a pipe 294 and valve 292, and be forced by pump 268 through pipe 288 into quench tank 132.

One example of the quenching operation provides covering a 6 inch diameter workpiece with the quenching liquid in 1.5 seconds from a level just below the workpiece. To adequately quench the workpiece, the upper level should be sufficiently above the workpiece to ensure complete coverage. Six inches of liquid above the workpiece is provided in an additional 1.5 seconds, for a total time of 3 seconds.

As another more precise example of the operation of quenching station 130, if the distance from the bottom of quench tank 132 to servicing level W is approximately 18 inches, while the distance from the bottom of the quench tank to lower level Z is approximately 28, the preferred distance between the bottom of the quench tank and upper level Y should be approximately 45 inches. Accordingly, the preferred embodiment provides an operating differential head of 17 inches between upper level Y and lower level Z. A discharge of 2,000 gallons per minute provides sufficient pressure with the above prescribed dimensions such that the rate of rise in the level for a quench station holding 134 gallons between levels Y and Z is:

$$17 \text{ in.} \times \frac{2{,}000 \text{ gal}}{\text{min.}} \times \frac{1 \text{ min.}}{60 \text{ sec.}} \times \frac{1}{134 \text{ gal.}} = 4.22 \text{ in/sec.}$$

At that rate, the time required to cover a 6 inch diameter part is:

$$\frac{6 \text{ in.}}{4.22 \text{ in/sec}} = 1.42 \text{ sec.}$$

The corresponding time to cover a 6 inch diameter piece to a level of 6 inches above the part is:

$$\frac{12 \text{ in.}}{4.22 \text{ in/sec}} = 2.84 \text{ sec.}$$

The time required to lower the level of quenching liquid to lower level Z is:

$$\frac{2{,}000 \text{ gal/min}}{800 \text{ gal/min}} \times 2.84 \text{ sec.} = 7.1 \text{ sec.}$$

While considerable emphasis has been placed herein on preferred embodiments of the invention and the specific structures and structural interrelationships of the component parts thereof, it will be readily apparent that many embodiments of the invention can be made, and that many changes can be made in the embodiments herein illustrated and described without departing from the principles of the invention. For example, the relative positions of the quench tank and storage tank shown in FIG. 7 could be reversed such that the valve is used to transfer the quenching liquid from the quench tank to the storage tank, while the pump is used to rapidly flood the quench tank. Further, if the quenching liquid is water, the storage tank can be eliminated by flooding directly from a water supply and emptying directly to a drain. Accordingly, it is to be distinctly understood that the foregoing descriptive matter is to be interpreted merely as illustrative of the invention and not as a limitation.

Having thus described the invention, the following is claimed:

1. A method of quenching a heated elongated workpiece having a central axis and spaced ends, the method comprising the steps of: providing a quench tank, providing workpiece supporting and rotating means at a fixed position in said tank, locating a heated workpiece at said selected fixed position in said quench tank, rotating said workpiece at said fixed position about said central axis, preventing transverse deflection of said workpiece as said workpiece is rotating at said fixed position, rapidly flooding said quench tank with a quenching liquid to a level above said selected position while said workpiece rotates at said selected fixed position and about said central axis whereby said workpiece is quenched, and forcing said quenching liquid from said quench tank to a level below said selected position after said workpiece is quenched.

2. The method according to claim 1 wherein locating said workpiece includes lifting said workpiece to said selected position with a lift means before quenching, and removing said workpiece from said selected position with said lift means after quenching said workpiece.

3. A method of quenching a heated elongated workpiece having a central axis and spaced ends, the method comprising the steps of: providing a tank means for holding a quantity of quenching liquid, providing workpiece supporting and rotating means at a fixed position in said tank means, locating a heated workpiece at said selected fixed position in said tank means, rotating said workpiece at said fixed position about said central axis while preventing transverse deflection of the rotating workpiece, increasing said quantity of quenching liquid in said tank means to a level above said selected position while said workpiece rotates at said selected position and about said central axis whereby said workpiece is quenched, and decreasing said quantity of quenching liquid in said tank means to a level below said selected position after said workpiece is quenched.

* * * * *